United States Patent [19]

Demas et al.

[11] 4,302,697

[45] Nov. 24, 1981

[54] PRESSURE RELIEF HOLE SEAL FOR A SEALED-BEAM HEADLAMP

[75] Inventors: Nickolas P. Demas, Cranford; James E. Bair, Millington; Robert A. Grunder, Cranford, all of N.J.

[73] Assignee: Wagner Electric Corporation, Parsippany, N.J.

[21] Appl. No.: 95,405

[22] Filed: Nov. 19, 1979

[51] Int. Cl.[3] ..... H01K 1/28; H01K 3/26

[52] U.S. Cl. ..... 313/113; 29/25.13; 313/222; 313/317

[58] Field of Search ..... 313/113, 114, 25, 222, 313/317; 141/66; 316/19, 20; 29/25.13

[56] References Cited

U.S. PATENT DOCUMENTS 4,146,812 3/1979 Gagnon ..... 313/113

*Primary Examiner*—Palmer C. Demeo
*Assistant Examiner*—Darwin R. Hostetter
*Attorney, Agent, or Firm*—Eyre, Mann, Lucas & Just

[57] ABSTRACT

The invention relates to automobile sealed-beam headlamps in which a reflector and lens assembly are hermetically sealed by an epoxy resin. A pressure relief hole in the reflector eliminates the problem of excessive expansion and contraction of the atmosphere within the lamp such as would prevent forming a hermetic seal between the reflector and lens during the epoxy resin curing cycle. A deformable metal pellet forms a hermetic seal in the pressure relief hole. An epoxy resin is applied over the deformable metal seal and cured to produce a final permanent seal.

3 Claims, 4 Drawing Figures

PRESSURE RELIEF HOLE SEAL FOR A SEALED-BEAM HEADLAMP

The invention relates to automobile sealed-beam headlamps. Typically a headlamp assembly consists of a reflector on which is mounted a tungsten filament or tungsten-halogen lamp and a lens to shape the beam of light from the reflector into a specified light pattern.

In the United States, automobile headlamp specification FMVSS #108 requires the use of sealed-beam headlamps. The hermetic seal has been found to significantly reduce the deterioration of the optical performance of the headlamp reflector by preventing accumulation of dust, dirt and water on the surface of the reflector so that the surface remains bright and untarnished.

In previous tungsten lamps, the reflector and lens formed the outer bulb which enclosed the tungsten filament along with an inert atmosphere which prevented the filament's oxidization. The lens and reflector were fused together in order to provide mechanical bonding as well as an impervious seal. But in fusing the lens to the reflector there was a significant breakage during production because of the stress induced into the reflector and lens from the heat required for the fusing process.

There have been many attempts to provide a more economic sealing method. In the tungsten lamps where the assembly took the place of a bulb these methods were limited by the fact that any out-gasing of the material of the seals was highly detrimental to filament life.

When specification FMVSS #108 was changed to allow increased candlepower it encouraged the use of tungsten-halogen lamps. The use of other methods of sealing the assembly thus become increasingly attractive. The fact that the tungsten-halogen cycle lamps uses a bulb with a halogen atmosphere sealed within the bulb eliminates the out-gasing problem associated with the use of other sealants.

Many attempts have been made to use resin for hermetically sealing the tungsten-halogen lamp sealed beam assembly. The "one part" epoxy resins are attractive for this application because of their durability and proven capabilities. However, these resins require heat-curing in order to form a permanent bond.

During the epoxy resin curing cycle, the atmosphere within the lamp will expand and contract and quite frequently this will force some of the resin out of the seal area and result in a non-hermetically sealed lamp. In accordance with the present invention, the reflector is provided with a pressure relief hole which eliminates the problem of building up excessive expansion and contraction of the atmosphere within the lamp such as would prevent forming a hermetic seal between the reflector and lens during the epoxy resin curing cycle.

The pressure relief hole is hermetically sealed after the main seal is formed between the reflector and lens. However, a significant number of sealing failures still occurred and the lamps did not have the desired hermetic seal when the pressure relief hole was sealed with epoxy resin. In every case, the failure to seal was attributed to a small pin hole formed in the epoxy resin within the pressure relief hole by either the expansion or the contraction of the atmosphere within the headlamp during the heat curing of the epoxy in the pressure relief hole. In accordance with the present invention, this problem is overcome by means of a deformable pellet which is forced into the pressure relief hole to form a seal. For best results, the pellet is a deformable metal and epoxy resin is applied over the deformable metal seal and cured to produce a final permanent seal. It is believed that forcing the deformable metal into the pressure relief hole causes the metal to flow into all irregularities surrounding the perimeter of the pressure relief hole to form a hermetic seal for the lamp. If epoxy resin is thereafter applied to the metal and cured, the hermetic seal of the metal remains intact and is reinforced by the epoxy resin hermetic seal.

The invention disclosed herein solves the problem of producing a reliable hermetic seal of epoxy resin between the lens and the reflector. The epoxy seal between the lens and reflector is formed with no significant pressure stress being applied thereto by having a pressure relief hole formed in the reflector to allow the equalizing of pressure. The pressure relief hole is then temporarily sealed by a deformable pellet which is pressed tightly into the pressure relief hole and deformed so as to fill the space. The deformable pellet for best results is a deformable metal pellet such as gold, silver, lead or tin alone or in combination, and preferably lead or tin or a combination of tin and lead is used.

These and other aspects of the present invention may be more fully understood with respect to the drawings in which.

Figure 1:
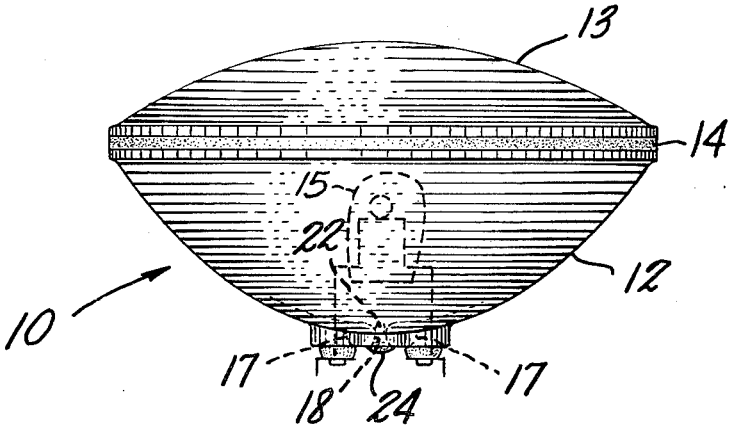
FIG. 1 is a side view of a headlamp assembly of the type to be sealed by an epoxy seal.

In FIG. 1 the numeral 10 refers generally to a sealed beam headlamp assembly in which a reflector 12 is bonded to a lens 13 by an epoxy resin hermetic seal 14. A conventional tungsten-halogen lamp 15 is preferably mounted in well known manner on the reflector within the enclosure. The bulb is electrically connected to base lugs or terminals 17 mounted outside of the assembly on the reflector 12.

An epoxy resin is chosen for seal 14 so that its expansion characteristics will in general match the expansion of the material of which the reflector and lens are made. For the present application, a heat curing, one part epoxy having such characteristics is used on the rim of the lens and reflector to provide both a mechanical bond and a hermetic seal 14 between the reflector 12 and the lens 13.

A pressure relief hole 18 shown in this embodiment is formed generally at the base of the reflector in the region of the base lugs 17. The pressure relief hole is necessary when curing the epoxy resin seal 14 in order to avoid pressure changes within the enclosed atmosphere such as may force epoxy resin out of the sealing area and prevent the formation of a hermetic seal 14 between the reflector and lens.

Figure 2:
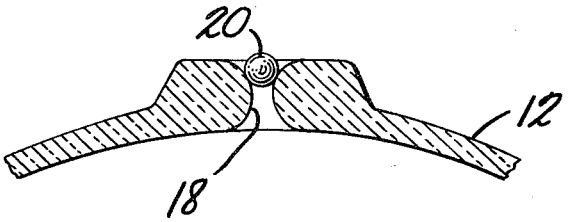
FIG. 2 is an expanded section of the reflector of FIG. 1 showing the deformable pellet in a first position in the pressure relief hole.

Referring now to FIG. 2, a deformable pellet 20 of lead which has at least one dimension larger than the pressure relief hole is placed in position over the pressure relief hole, shown here in an expanded cross-section.

Figure 3:
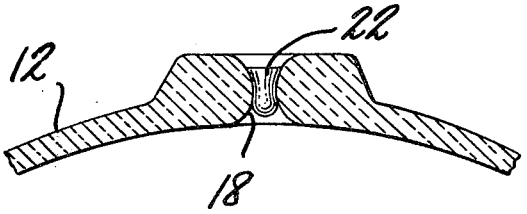
FIG. 3 is the same expanded section of the reflector of FIG. 2 showing the final position of the deformable pellet.

Upon application of a sufficient, but limited, driving pressure the pellet 20 is deformably forced into the pressure relief hole into a position and shape shown generally in FIG. 3 at 22. The deformed pellet in the position shown at 22 is sufficiently tight to form a temporary hermetic seal within the pressure relief hole 18.

Figure 4:
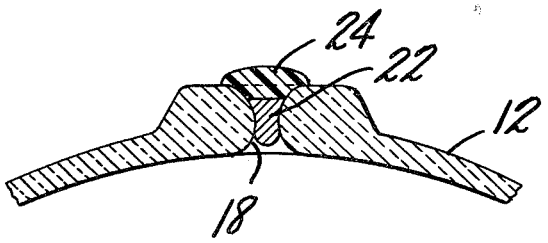
FIG. 4 shows the same expanded section of the reflector with the permanent epoxy hermetic seal in place in the pressure relief hole.

FIG. 4 shows the deformed pellet 22 after being forced into pressure relief hole 18 and further shows a permanent epoxy layer or cap 24 which forms a permanent epoxy seal for the assembly. The epoxy can be the same as that chosen for sealing the lens to the reflector or may be chosen so that its expansion characteristics are in general similar to those of the material of the reflector. The hardened and heat cured epoxy resin forms a rigid seal 24 which will expand at about the same rate as the reflector material and thereby cause no stresses. An epoxy that has been used in the preferred embodiment is that made by Amicon Corporation with their designation 927-68-3. The curing temperature of this epoxy is 250° F.

In a preferred process, the assembly is heated to a temperature of approximately 320° F. This temperature activates the hardener in the epoxy to form the epoxy seal 14. As the assembly is removed from the heat it begins to cool and after pellet 22 is in position to form a temporary seal, an epoxy layer 24 is extruded into the pressure relief hole on top of the deformed metal pellet to form the final permanent seal while the unit is cooling down to room temperature.

While the present invention is of particular advantage in the manufacture of lamps wherein the hermetic seal of lens to reflector is formed with a heat cured epoxy resin, the invention may also be used with respect to lamps in which the reflector is hermetically sealed by other means such as flame sealing or fusion.

It will be understood that the claims are intended to cover all changes and modifications of the preferred embodiment of the invention, herein chosen for the purpose of illustration which do not constitute departure from the spirit and scope of this invention.

What is claimed is:

1. In a sealed beam headlamp assembly of the type having a tungsten-halogen bulb, a reflector, and lens, said reflector and lens having rims joined together by a hermetic seal the improvement comprising:

(a) a pressure relief hole positioned in said reflector;

(b) a deformable metal pellet deformably-press fitted into said pressure relief hole whereby a temporary hermetic seal is formed; and (c) a heat cured epoxy resin seal in said pressure relief hole over said pellet.

2. The sealed beam headlamp assembly of claim 1 wherein said deformable metal is selected from the group of lead, tin and combinations of lead and tin.

3. In the method of assembling a sealed beam headlamp of the type having a lens, a tungsten-halogen bulb and a reflector with a pressure relief hole therein which comprises the steps of bonding the periphery of the lens and reflector together by applying epoxy resin in a continuous layer to the periphery between the lens and reflector, heating the assembled lens and reflector to heat cure the epoxy resin, the improvement comprising thereafter positioning over the pressure relief hole a metal pellet having at least one dimension larger than the smallest dimension of said pressure relief hole and applying force to said metal pellet to deform it and force it into said pressure relief hole and applying an epoxy resin cap over the metal pellet in said pressure relief hole and heat-curing the epoxy resin.

* * * * *